US006746009B2

(12) United States Patent
Engarto et al.

(10) Patent No.: US 6,746,009 B2
(45) Date of Patent: Jun. 8, 2004

(54) DROP POCKET SYSTEM AND METHOD FOR REORIENTING FLAT ARTICLES

(75) Inventors: Edward Engarto, Sayre, PA (US); Robert J. Felice, Endicott, NY (US); Patrick J. Fitzgibbons, Newark Valley, NY (US); Drew D. Havholm, Vestal, NY (US)

(73) Assignee: Lockheed Martin Corporation, Owego, NY (US)

( * ) Notice: Subject to any disclaimer, the term of this patent is extended or adjusted under 35 U.S.C. 154(b) by 0 days.

(21) Appl. No.: 10/150,786

(22) Filed: May 17, 2002

(65) Prior Publication Data

US 2003/0214093 A1 Nov. 20, 2003

(51) Int. Cl.[7] ..... B65H 29/36

(52) U.S. Cl. ..... 271/2; 271/225; 271/185; 198/457.03

(58) Field of Search ..... 271/2, 3.12, 225, 271/184, 185; 198/407, 457.01–457.03

(56) References Cited

U.S. PATENT DOCUMENTS

| | | | | |
|---|---|---|---|---|
| 4,604,851 A | | 8/1986 | Reist | 53/430 |
| 5,131,645 A | * | 7/1992 | Ricciardi | 271/181 |
| 5,362,040 A | * | 11/1994 | Midavaine et al. | 271/225 |
| 5,421,699 A | * | 6/1995 | Guiles et al. | 414/788 |
| 5,462,268 A | * | 10/1995 | Remy et al. | 271/225 |
| 5,860,504 A | | 1/1999 | Lazzarotti | 198/357 |

* cited by examiner

*Primary Examiner*—Christopher P. Ellis
*Assistant Examiner*—Mark A. Deuble
(74) *Attorney, Agent, or Firm*—Perkins Smith & Cohen LLP; Jacob N. Erlich; Peter J. Borghetti

(57) ABSTRACT

A drop pocket system and method reorients flat articles in a serial stream, by horizontally receiving a horizontally moving, serial input stream of substantially vertically oriented flat articles, sensing reception of each flat article, engaging each sensed flat article, accelerating each engaged flat article into substantially downward movement, and conveying each flat article with the downward movement into a substantially horizontal orientation and movement.

9 Claims, 6 Drawing Sheets

DROP POCKET SYSTEM AND METHOD FOR REORIENTING FLAT ARTICLES

FIELD OF THE INVENTION

This invention relates generally to mail handling systems, and, more particularly to a system for reorienting a moving stream of generally flat articles.

BACKGROUND OF THE INVENTION

In the field of automated mail processing, there are numerous inventions and machines designed to handle uniformly dimensioned articles, typically known as first class mail, ranging in size from post cards to business letter envelopes. There are, however, a limited number of machines designed to automate the processing of larger flat articles otherwise known as "mail flats," which may be up to fifteen inches square and one and a quarter inches thick.

Current practices in automated mail handling include the placement of batches of flat mail, or mail flats, into feeders, which separate the individual pieces and expel those pieces in a serial stream having a vertical orientation and a predetermined periodicity or pitch between the leading edges of adjacent pieces. The mail flats in this vertically oriented stream are then reoriented and placed on a horizontal conveyor with another predetermined periodicity, for the purpose of further handling and processing. This reorientation process can be particularly challenging for several reasons.

One challenge to the reorientation process is the handling of magazines and newspapers. Magazines must be automatically handled by their bound edge, and newspapers must be handled along their final fold. This requirement is critical to achieving any sort of speed in the automatic handling process. For this reason, these articles are placed in the feeder bin with the bound edge or final fold facing downward and are expelled from the feeder in this orientation. Later, when magazines and newspapers are placed on the horizontal conveyor, they must have their bound edge or final fold facing forward for proper handling. Therefore, the reorientation step must be performed so that the bottom edge of the vertically oriented mail flats becomes the leading edge of the horizontally oriented mail flats.

Space constraints are another challenge in the reorientation process. Input feeders typically have maximum height, ergonomic limitations to allow an operator to conveniently and safely place stacks of mail into the feeder. The horizontal output conveyors typically have minimum height requirements for receiving the mail flats because of similar constraints in removing objects. Therefore, the reorientation apparatus is limited in the amount of height that it can use for the reorientation process. The height restriction is further aggravated by the size and nature of the mail flats to be handled. As mentioned, such mail flats may be up to 15 inches by 15 inches, with thicknesses up to 1¼ inches. Automatically reorienting a stiff 15×15×1.25 inch parcel is much more challenging than reorienting a flexible magazine.

Mail processing machinery also needs to operate at a sufficient throughput, commonly measured as "pieces per hour" (pph), that is economically viable for the mail handling agency to sacrifice the electrical power and space requirements as well as justify the capital expenditure. The machinery must also have sufficient throughput and accuracy to justify replacement of manual labor.

A common method of handling mail is from a horizontally oriented conveyor. The horizontal conveyor affords the easiest means for handling mail flats. Also, various other devices, such as scanners, cameras and sorters, have already been designed to work with such conveyors. A key hurdle in designing systems is how to achieve high throughput without adjacent pieces colliding with each other. U.S. Pat. No. 5,860,504 discloses machinery that places mail flats on a horizontal conveyor using multiple input feeders, which individually sense openings on the horizontal conveyors and then deliver their individual pieces to the sensed openings. The mail flats being handled have already been reoriented for proper placement on the horizontal conveyor.

SUMMARY OF THE INVENTION

In one form, the present invention provides a system for reorienting flat articles in a serial input stream, including an input pocket located to receive a horizontally moving stream of substantially vertically oriented flat articles, a sensor located to sense the reception of each flat article in the input pocket, a drivable element located to engage each flat article in response to its sensed reception, a drive mechanism connected to the drivable element and adapted to controllably accelerate engaged flat articles substantially downwardly, and an effective curved path channel located to receive flat articles moved substantially downwardly from the drivable element and shaped to convey such received flat articles toward a substantially horizontal orientation.

In one refinement of the above embodiment, the input pocket includes an inclined element located to impart rotational movement to each flat article entering the input pocket using the horizontal movement thereof, and the input pocket includes an inclined member located to receive each flat article and stop rotational movement thereof In another refinement of the above embodiment, each input pocket includes a trap door located for supporting a bottom edge of each flat article received in the input pocket, and also includes an actuator adapted for opening the trap door to allow downward movement of flat articles from the drop pocket. In a further refinement, the drivable element includes an engagement mechanism adapted to cause engagement of the flat articles by the drivable element.

In a still further refinement, a control system is included and coupled to the sensor, the trap door actuator, the engagement mechanism and the drivable element. The control system is adapted to respond to the sensed reception of flat articles in the drop pocket to activate the engagement mechanism to engage flat articles, to activate the trap door actuator to open the trap door and to activate the drive mechanism to accelerate engaged flat articles.

In yet a separate refinement, the effective curved path channel includes a driven conveyor located to engage flat articles and having a lower, flexible belt conveyor located to support flat articles along the entire length of the effective curved path channel and an upper, flexible belt conveyor adapted to place force on the lower, flexible belt conveyor and flat articles located thereon.

In another form of the present invention, a system for conveying flat articles from a substantially vertically oriented position to a substantially horizontally oriented position includes an effective curved path channel having a substantially vertically oriented input port and a substantially horizontally oriented output port, a lower, driven flexible belt conveyor located to form a lower boundary of the effective curved path channel from the input port to the output port, and an upper, driven flexible belt conveyor located to place force on a portion of the lower, flexible belt conveyor and any flat articles located between the lower, flexible belt conveyor and the upper, driven flexible belt conveyor.

In a refined version of this embodiment, the upper, flexible belt conveyor includes a supported driven axle, at least one free axle supported from and kept parallel to the driven axle, the free axle having a location which is angularly movable with respect to the driven axle, and at least one flexible belt engaged by the driven and free axles, wherein the free axle is adapted to place the force on the lower, flexible belt conveyor and any flat articles located between the lower, flexible belt conveyor and the free axle.

The method of the present invention covers reorienting flat articles in a serial input stream, including the steps of receiving a horizontally moving, serial input stream of substantially vertically oriented flat articles, sensing reception of each flat article, engaging each sensed flat article, accelerating each engaged flat article into substantially downward movement, and conveying each flat article with the substantial downward movement into a substantially horizontal orientation and movement.

In a refinement of this method, the step of receiving includes partially rotating each flat article towards the substantially horizontal orientation. In a further refinement, the step of receiving the input stream of flat articles includes supporting a bottom edge of each flat article with a trap door, and the step of accelerating the engaged flat article includes opening the trap door.

BRIEF DESCRIPTION OF THE DRAWINGS

The present invention is illustratively described and shown in reference to the appended drawings in which.

DETAILED DESCRIPTION OF THE DRAWINGS

The embodiments described herein are directed to the handling of mail flats. However, these embodiments may also be used for handling other similar flat articles which might not fall within the definition of mail flats.

Figure 1:
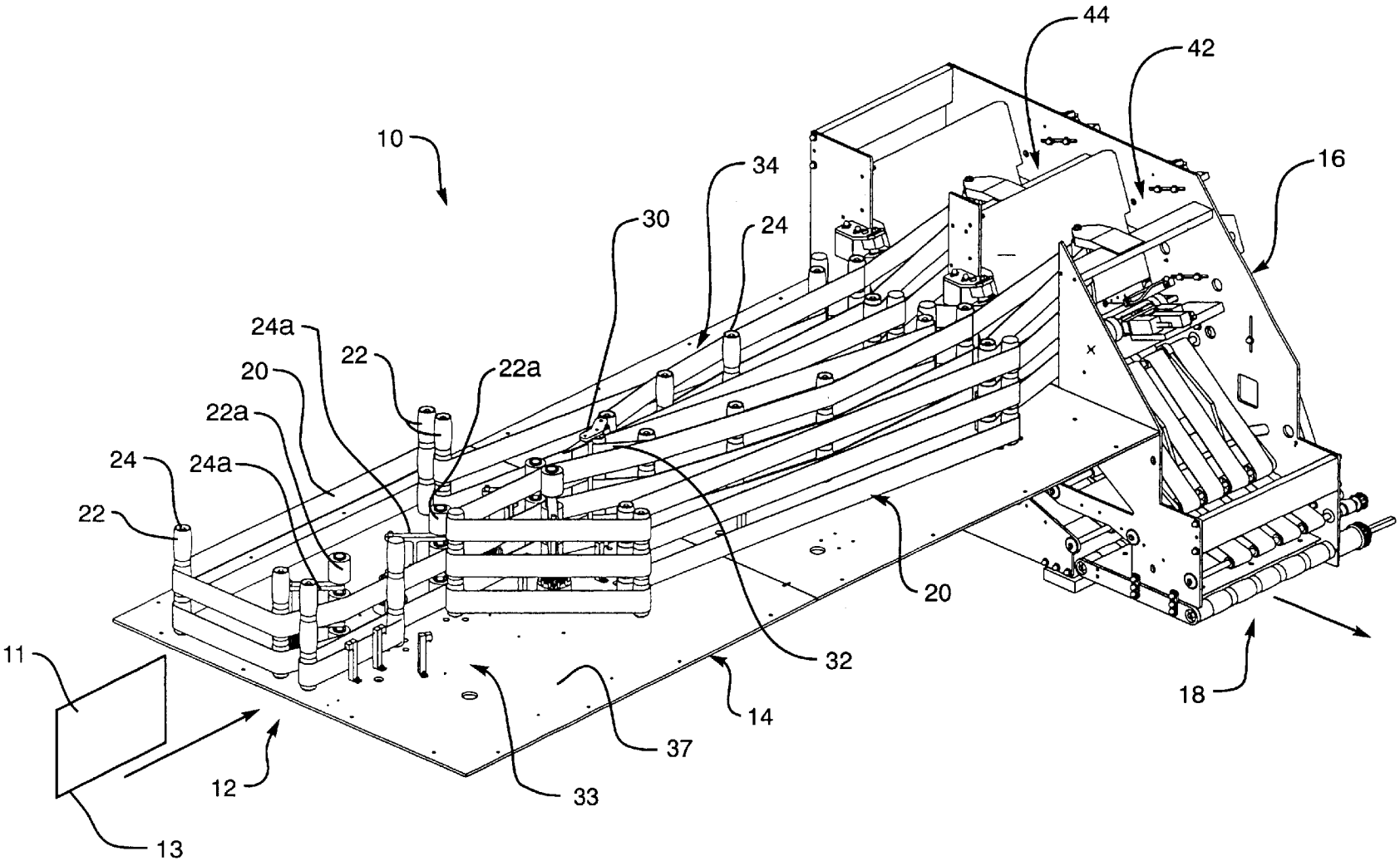
FIG. 1 is a perspective view of a system constructed to incorporate an embodiment of the present invention.

For a better understanding of the present invention, reference is made to an overall system in conjunction with which, the invention may be preferably, but not exclusively used. For example, a mail flat handling system 10 is illustratively shown in FIG. 1 and generally includes an input port 12 for receiving a horizontally moving input stream of vertically oriented mail flats 11, a conveyor mechanism 14 for handling the vertically oriented mail flats 11, a drop pocket section 16 and a horizontally oriented output port 18. Mail flats 11, having a downwardly oriented primary edge 13, are conveyed from input port 12 and through conveyor mechanism 14, by a multiplicity of vertically mounted conveyor belts 20 which engage the vertically oriented mail flats on opposing sides. Conveyor belts 20 are mounted on various vertically mounted rollers 22, and rollers 22 are in turn mounted on various fixed and biased position axles 24, all in accordance with practices known in the art. The biased position axles are used in a known manner to maintain lateral pressure from the conveyor bands 20 on opposing sides of the mail flats 11 while compensating for the various allowed thicknesses for such mail flats. Conveyor belts 20 are typically driven by a motor located below the deck 37 of conveyor mechanism 14. Several conveyor belts 20, that are normally used in mechanism 14 are missing from FIGS. 1 and 2 for purposes of clarity, but their form, fit and function would be obvious to someone skilled in the art based upon the current disclosure.

A particular aspect of conveyor mechanism 14 is that it includes a diverter gate 30 for dividing or splitting the input stream of mail flats alternately between two output paths 32 and 34. In this manner, sequential mail flats in the input stream, are diverted into or split between the paths 32, 34. These alternate paths 32, 34 each lead to a separate drop pocket 42, 44, respectively, of drop pocket section 16.

Figure 2:
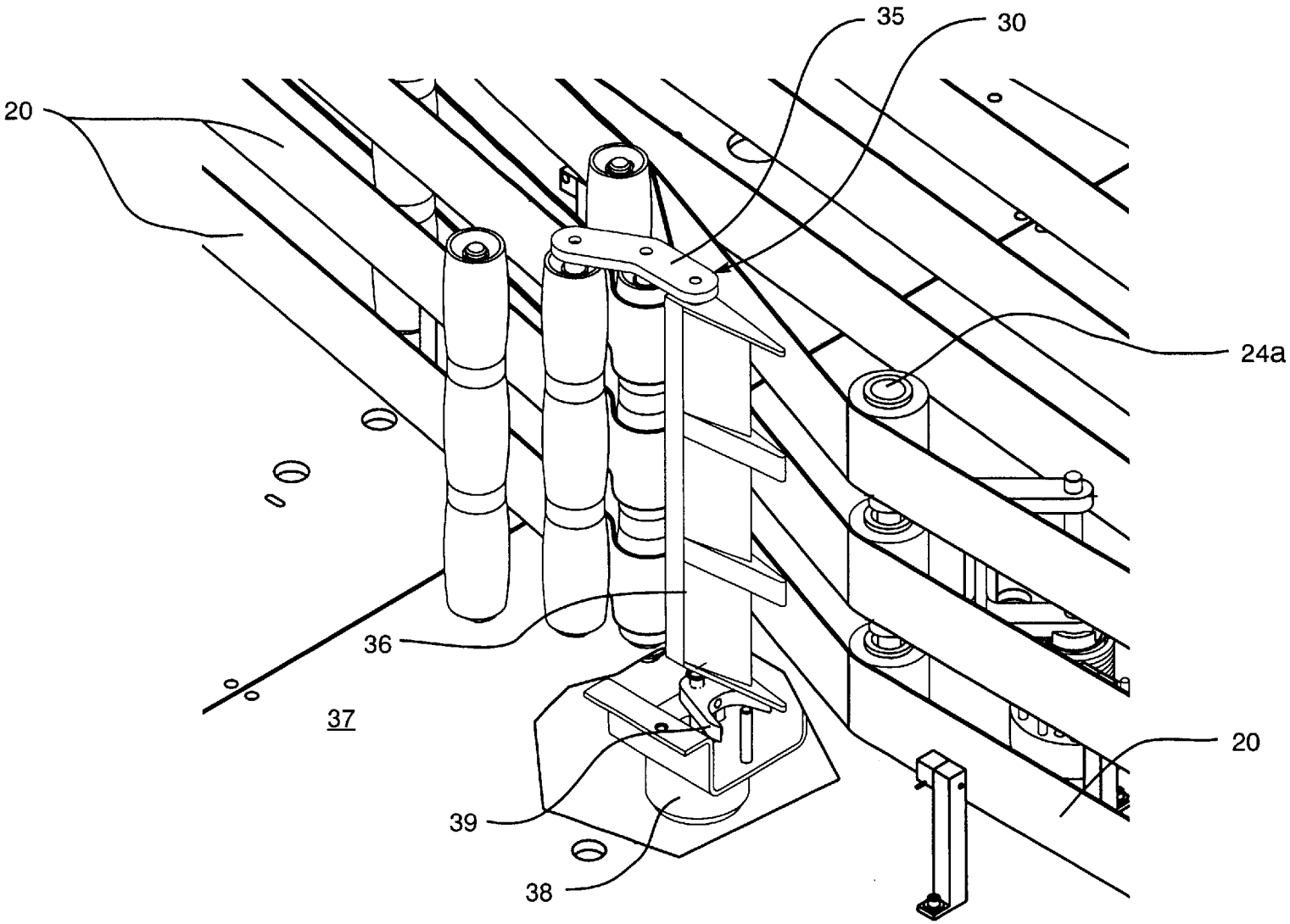
FIG. 2 is an enlarged and partially exposed view of a portion of the system of FIG. 1.

FIG. 2 shows an enlarged view of diverter gate 30 and the corresponding portion of the conveyor mechanism 14. Gate 30 generally includes a diverter vane 36 mounted to the drive shaft of a rotary solenoid 38. Diverter vane 36 is located in the mail stream above conveyor deck 37 while rotary solenoid 38 is mounted below deck 37 and connected to vane 36 through a hole in deck 37. The upper end of vane 36 is rotationally mounted in a strut 35. Also affixed to the drive shaft of rotary solenoid 38 is a limiter 39 for defining the range of motion of vane 36. The control of diverter vane 36 may be accomplished by any suitable mechanism such as the rotary solenoid 38 or by any suitable compressed air device. Rotary solenoids are commercially available, and the current solenoid 38 includes a spring return which is sufficient for purposes of the present system. In operation, diverter vane 36 is spring biased to divert mail flats into one of the two paths 32, 34 and then electrically flipped to divert alternating mail flats into the other path.

Conveyor mechanism 14 may also incorporate various forms of peripheral devices, such as scanners, cameras and bar code printers, for processing the mail flats. Such peripheral devices may be mounted on either side of the mail stream, and even on both sides in cases where the address label may be oriented in either direction. Conveyor mechanism 14 shows a space 33 in FIG. 1 where a peripheral device may be mounted to access the mail flats 11. In the space 33, the conveyor belts 20 are not present on the right hand side of the input path, to allow unrestricted access to the mail flats by a peripheral device. Also shown are two sets of biased position rollers, with each set mounted on a biased gate axle 24*a*. In this manner, gates 24*a* are movable to compensate for various thicknesses of the mail flats, while the right hand side of each mail flat passes the same location for consistent access by a peripheral device. FIG. 2 shows an additional biased gate axle 24*a*, which is spring biased towards a similar opposed axle (not shown). This combination of biased gate axles 24*a* can be used for providing overall tension to conveyor belts 20, as well as for providing appropriate lateral pressure to individual mail flats of different sizes. The present system 10 avoids collisions between mail flats and apparatus jams by spitting the input mail stream between two or more separate paths 32, 34, and drop pockets 42, 44. This approach enables the system 10 to function at the high throughput rates available from contemporary feeders. Although the use of more than two separate paths is possible, the use of only two paths is preferable for the purpose of reducing size, cost and complexity of the system 10.

The present invention is now illustratively described in reference to FIGS. 3–6, in the form of drop pockets 42, 44 which perform the process of reorienting, or changing the direction of travel of the mail flats by first decelerating or impeding the relative lateral or horizontal movement of the mail flats and then accelerating the mail flats in their relative vertical or longitudinal direction. The description herein of "drop" pockets is intended to be taken illustratively as various pocket-type devices may be used. Drop pockets 42, 44 are constructed from matching components which bear the same reference numbers for both drop pockets.

Figure 3:
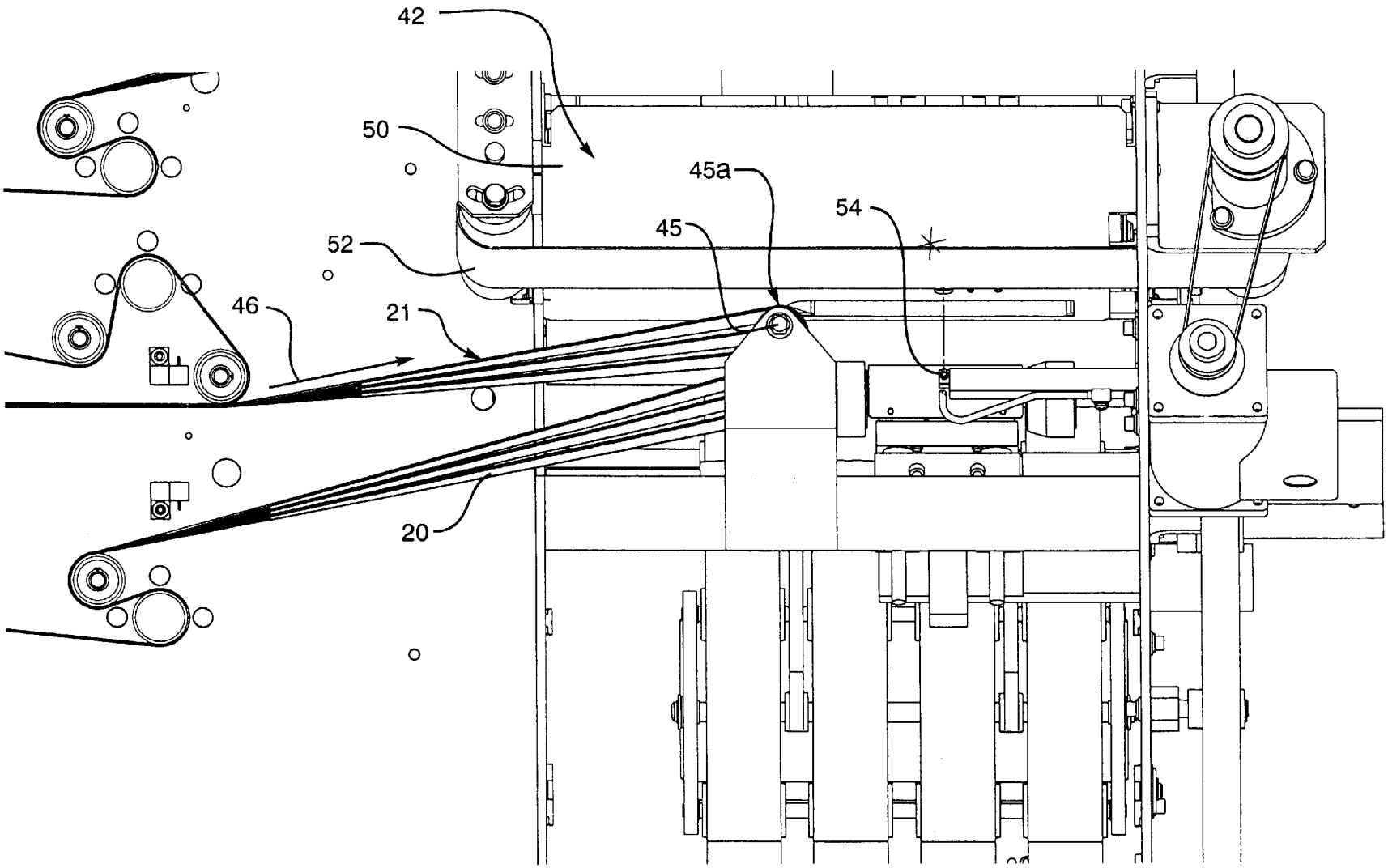
FIG. 3 is a partial top view of the system of FIG. 1 including some details of one embodiment of the present invention.
Figure 4:
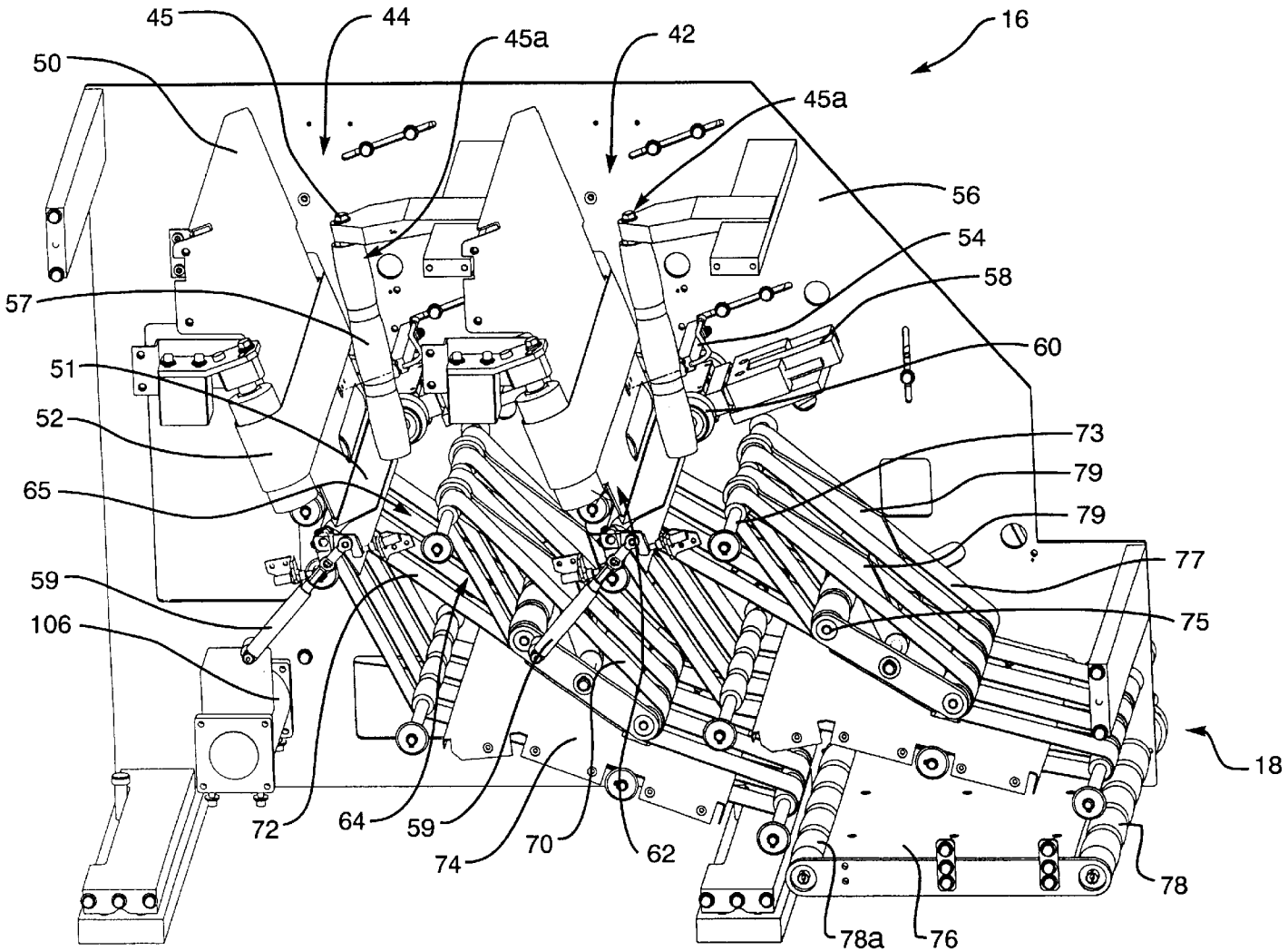
FIG. 4 is an exposed perspective view of a drop pocket section constructed in accordance with one embodiment of the present invention.

FIG. 3 shows an enlarged top view of drop pocket 42 including the coupling of conveyor belts 20 thereto. The longest end 21 of conveyor belts 20 is shown mounted on an inclined or slanted axle 45 mounted on drop pocket 42. As also shown in FIG. 4, axle 45 is at an angle of approximately ten (10) degrees from the vertical orientation of the input mail stream. Individual mail flats exit from between opposing conveyor belts 20 as indicated by arrow 46. Because of the speed at which the mail flats are traveling and the angle of axle 45, the mail flats are rotationally accelerated and imparted with rotational movement in the counter-clockwise direction relative to their direction of travel. This action begins the reorientation of the mail flats. In this manner, the end 21 of belts 20 with the inclined axle 45 and any associated rollers form an inclined element 45*a* which rotationally accelerates mail flats using their own horizontal movement into drop pockets 42, 44.

FIG. 4 shows an exposed view of drop pocket section 16, detailing the mechanism for each drop pocket 42, 44. Mail flats entering each drop pocket 42, 44 are received by a flat member or slider plate 50 and a trap door 51, under bias from a driven belt 52. In the present embodiment, slider plate 50 is inclined at an angle of approximately twenty (20) degrees from the vertical causing each mail flat to be held against driven belt 52 by a portion of its own weight. This angle can generally have a wide range of values. In one embodiment, the range is from ten to thirty degrees. The angle of slider plate 50 thus defines initial rotation of the mail flats in the reorientation process. As mentioned in reference to FIG. 3, inclined element 45*a* imparts a counter-clockwise rotation to the mail flats due to their horizontal velocity, which generally causes the mail flats to rotate to the full angle of slider plate 50 and impact thereon. This rotation enhances the overall height efficiency of the reorientation process.

Each mail flat impacts the side apparatus plate 56 and any potential bounce back of the mail flats from plate 56 is affected by driven belt 52, which is constantly running and biasing the mail flat towards plate 56. In this manner, the overall horizontal movement of mail flats is impeded or blocked and the justification of the mail flats within each drop pocket is maintained with a certain consistency.

As mentioned, mail flats within each drop pocket are also supported by a trap door 51. The position of trap door 51 may be manipulated by any suitable means as represented by actuator 59. Commercially available actuators may be used, such as a dual action, compressed air unit.

An optical sensor 54, or beam of light (BOL), senses the presence of each mail flat as it obscures the opening 57 in slider plate 50. This sensing causes a pinch roller actuator 58 to move a pinch roller 60 against the sensed mail flat and thereby positively engage the sensed mail flat against an opposing pinch roller 62. Actuator 58 causes pinch roller 60 to press against and engage one side of the sensed mail flat. This pressure is typically transmitted through the mail flat pressing the other side thereof against opposing pinch roller 62.

Pinch rollers 60, 62 are then used in conjunction with the opening of trap door 51 to positively accelerate the engaged mail flat in a direction perpendicular to its relatively lateral path of entry into the drop pocket. In one embodiment, pinch rollers 60, 62 are both driven to best control acceleration of the mail. This location of pinch rollers 60, 62 provides positive engagement of mail flats, as well as acceleration thereof, under a high degree of control over the mail flats and thus enables system 10 to operate at a high throughput. Alternatively, only a single driven roller may be used in conjunction with a second, free roller resulting in an system with less performance. Actuator 58 may be formed by any suitable mechanism. In the present embodiment, actuator 58 is a dual action, compressed air driven slider, which allows direct, positive control over the location of pinch roller 60.

Pinch rollers 60, 62 accelerate each mail flat substantially downwardly in the direction of its downwardly oriented primary edge. The specific angle at which mail flats are accelerated from the pockets can vary significantly depending upon the design of the pocket used. Thus, all useable pockets may not be termed "drop" pockets.

Mail flats are thus accelerated from drop pockets 42, 44 into an effective curved path channel 64 defined by upper and lower, flexible belt conveyors 70, 72, respectively. Each effective curved path channel 64 includes a relatively higher, substantially vertically oriented input located adjacent trap door 51 and a relatively lower, substantially horizontally oriented output at port 18. Lower, flexible belt conveyor 72 forms one side of the effective curved path channel 64 from input to output and functions to drive and support mail flats within channel 64.

Upper, flexible belt conveyor 70 includes a supported driven axle 73, a ganged pair of free axles 75 and a plurality of flexible conveyor belts 77 engaging the driven and free axles. Ganged axles 75 may optionally be replaced by a single axle. Ganged axles 75 are supported from the driven axle 73 and kept parallel thereto by a pair of struts 79. Struts 79 do not receive or transmit rotational force with any of the axles 73, 75. Instead, struts 79 merely maintain the axles 73, 75 in a parallel relationship. In this manner, the location of ganged axles 75 is free to move angularly with respect to driven axle 73. This free movement allows a portion of the weight of ganged axles 75 and struts 79 to exert force upon lower conveyor 72 and thereby provide tension to the belts of lower conveyor 72. In this manner, free axles 75 are adapted to exert force on lower conveyor 72 and any mail flats located between lower conveyor 72 and ganged axles 75. The force created by axles 75 is not intended to be limited to the weight of ganged axles 75, but may also be created by any suitable means, such as a spring bias.

Channel 64 and conveyors 70, 72 are aided by an optional fixed skid plate 74 to support heavier mail flats. Although the various sections of the conveyors 70, 72 appear straight and skid plate 74 may be flat, the multiple belts of conveyors 70, 72, as well as the positioning of conveyor 70, are designed to be flexible to fully engage and accommodate mail flats which may be both thick and stiff, and the overall effect of path 64 is that of a curved path from the slider plate 50 to the horizontal orientation represented by conveyor platform 76. The degree of curvature is not intended to be limited by the present embodiment but is loosely defined in each specific system by the degree of initial rotation achieved in the pockets as well as the final degree of horizontal orientation necessary at output port 18. Platform 76 is shown in FIG. 4 without the normal drive belts that would be suspended between rollers 78, 78*a*.

In operation, the upper and lower conveyors 70, 72 run at the same speed and also at the speed used by conveyors interfacing with output port 18. Engagement of the mail flats by both upper and lower conveyors 70, 72 insures that the mail flats have the proper velocity after acceleration by pinch rollers 60, 62 and any affects from gravity and friction. Proper acceleration is also enhanced by the spacing of upper conveyor 70 from the trap door 51 or input port 65. This spacing avoids engagement of larger mail flats between upper and lower conveyors 70, 72 while pinch rollers 60, 62 are still moving such larger mail flats from the drop pockets. This allows greater control of the speed and timing (or position) of mail flats by the pinch rollers 60, 62.

Figure 5:
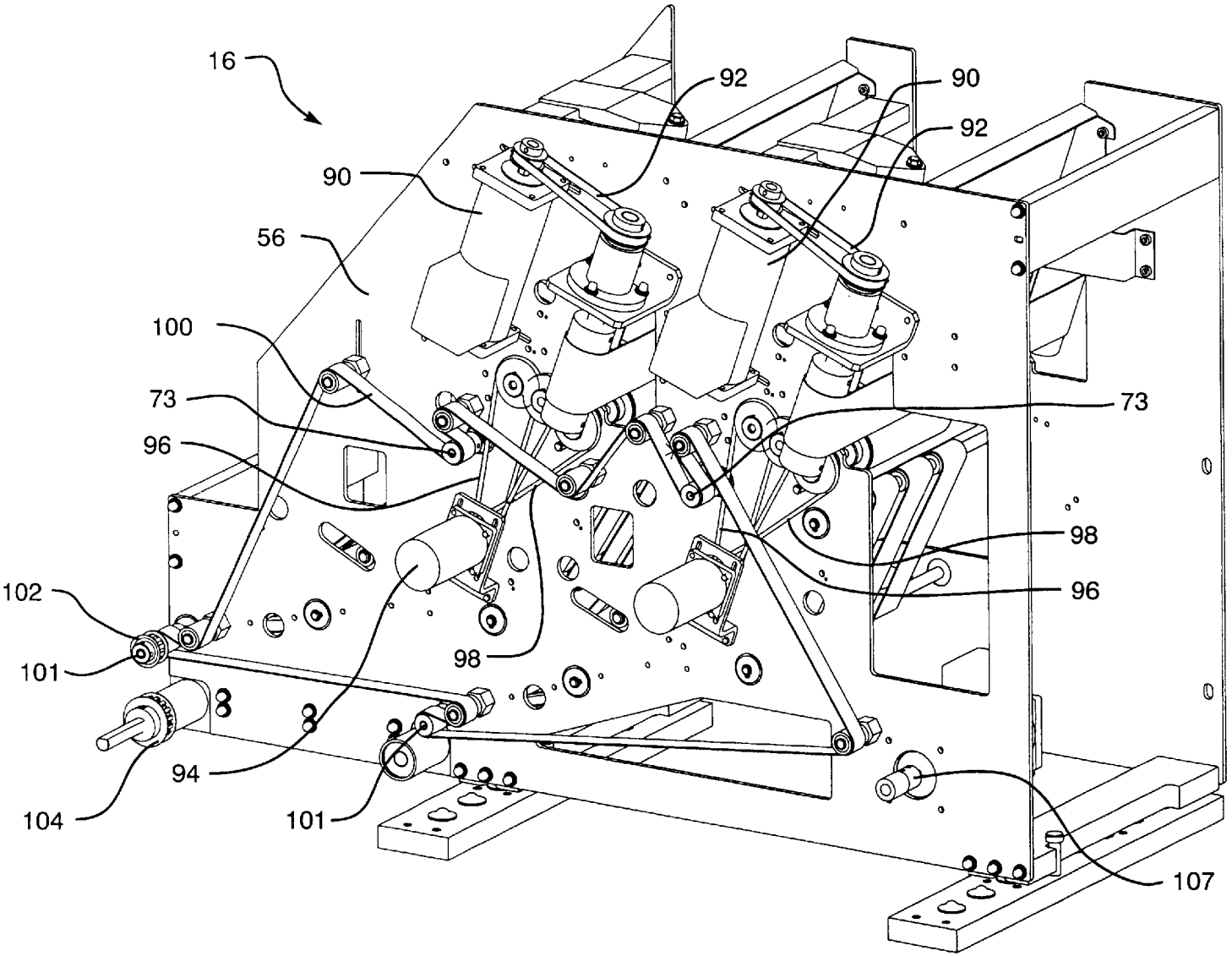
FIG. 5 is a rotated perspective view of the drop pocket section of FIG. 4.

FIG. 5 shows the back side of drop pocket section 16, on which are mounted many of the drive components used by section 16. Again, identical components for each drop pocket are identified with the same reference number. Driven belt 52 is moved by a constantly driven motor 90 coupled by a drive belt 92, all of which are mounted from the back apparatus plate 56. Each pair of pinch rollers 60, 62 are driven by a single servo motor 94 coupled to pinch rollers 60, 62 by a pair of drive belts 96, 98, respectively. To achieve rotation of pinch rollers 60, 62 in opposite directions, a circular cross-section drive belt 98 is used with a half twist, which twist is not present in belt 96. Also, proper tension is maintained on belt 96 by generally locating it in a direction perpendicular to the direction of movement of pinch roller 60.

A single drive belt 100 is also shown powering the conveyors 70, 72 of both drop pockets 42, 44 through their respective driven axles 73, 101. The speed of upper and lower conveyors 70, 72 is intended to be a predetermined constant which matches the speed of any horizontal conveyor located to receive mail flats from output port 18. Because the mail flats are only held on the conveyor by weight and friction, the velocity of mail flats delivered by system 10 should match the speed of any recipient belt to avoid any disruptive acceleration to the mail flats. Drive belt 100 is driven through a toothed gear 102, which is intended to be coupled, along with rollers 78 through toothed gear 104 to the receiving horizontal conveyor (not shown). Belt 100 may alternatively be driven by separate motor 106 of FIG. 4 and its drive shaft 107.

Figure 6:
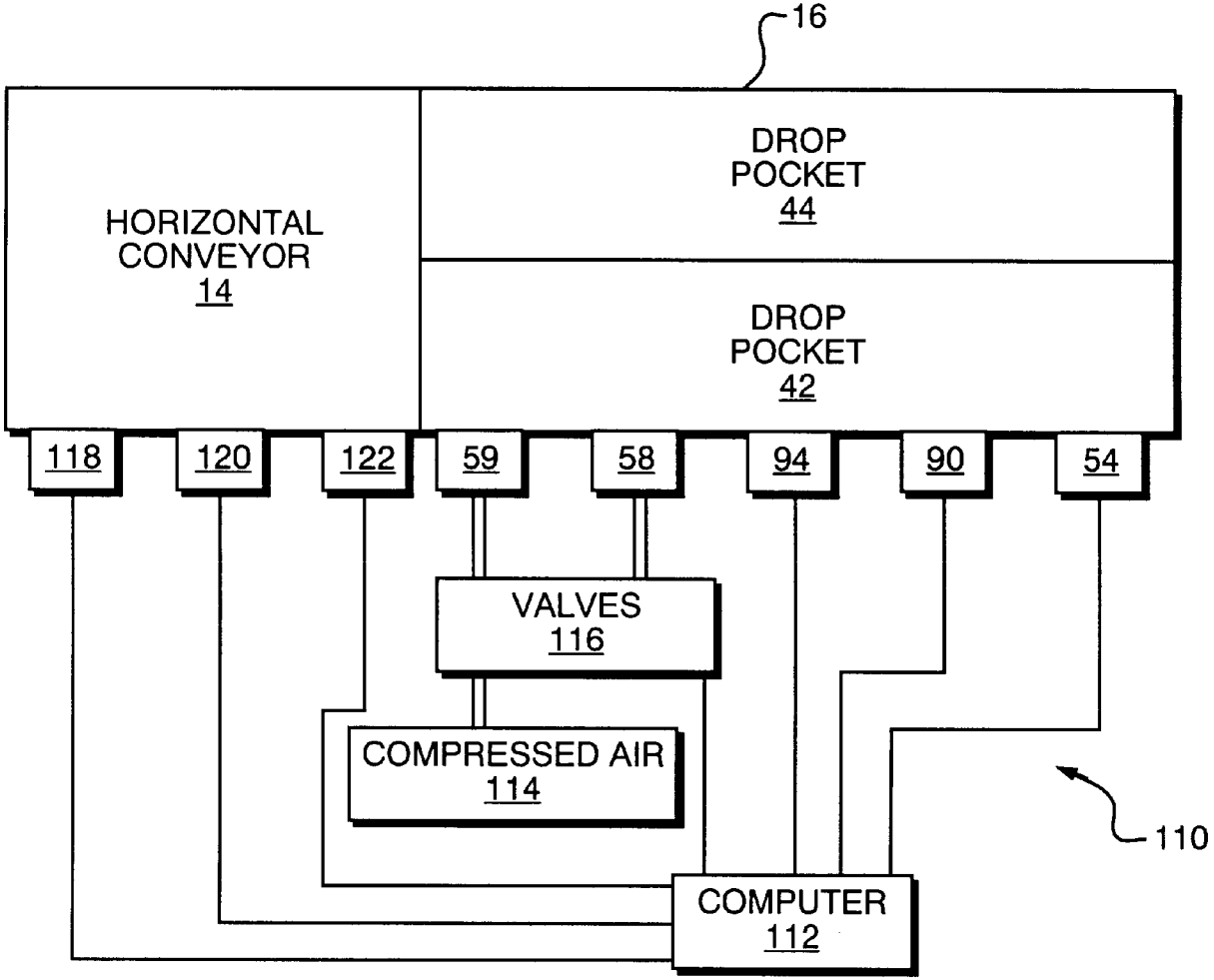
FIG. 6 is a functional block diagram of the system of FIG. 1.

FIG. 6 shows a functional block diagram of the system 10 in connection with a control system 110, which general includes a computer 112, a compressed air source 114 and a valve system 116 for controlling delivery of the compressed air. Horizontal conveyor 14 and drop pocket section 16 are shown as functional blocks with the associated actuators, motors and sensors attached thereto. Horizontal conveyor 14 has a peripheral device 118, a conveyor drive motor 120 for conveyor belts 20, and a diverter gate actuator 122 attached thereto. Drop pocket section 16 representatively shows drop pockets 42 and 44, along with trap door actuator 59, pinch roller actuator 58, pinch roller servo motor 94, driven belt motor 90 and beam of light sensor 54 attached to drop pocket 42. Each of the components so attached to drop pocket 42 would be duplicated for drop pocket 44, but are not shown here for purposes of clarity. Various other sensors (not shown) may also be used in conjunction with the current embodiment in ways known to persons skilled in the art. One example would be extra beam of light sensors for monitoring the progress of mail flats through system 10. Also computer 112 may be dedicated to the operation of system 10 or it may be a part of a larger process control computer.

In operation, computer 112 normally keeps conveyor drive motor 120 and driven belt motor 90 constantly running. Computer control of these motors allows emergency shut down and might even be used to provide speed control. During operation, peripheral device 118 might be used to determine the precise position of mail flats to enable computer 112 to provide precise control of diverter gate actuator 122. As mentioned, diverter gate actuator 122 may take the form of rotary solenoid 38, as taught, or the form of a compressed air actuator. As with all of the compressed air actuators, computer 112 provides control signals to valve section 116 to control the delivery of compressed air.

Next, mail flats entering each of drop pockets 42, 44 trigger the BOL sensor 57, which is monitored by computer 112. Computer 112 responsively directs compressed air to pinch roller actuator 58 causing pinch roller 60 to be pressed against and engage one side of the sensed mail flat. In conjunction with this engagement, computer 112 sends air pressure to actuator 59 to open trap door 51. After an appropriate delay, computer 112 energizes pinch roller servo motor 94.

One control aspect resides in the delay used by computer 112 to activate the pinch roller servo motor 94 to drive mail flats from each drop pocket. A certain nominal delay may be used to allow the engagement of each mail flat and the opening of trap door 51. An additional delay is also used for the drop pocket 42, which is located closest to the output port 18. The closer orientation of drop pocket 42 to output port 18 means that the mail flats travel a shorter distance, and correspondingly, the respective curved path channel 64 is shorter. In order to run the upper and lower conveyors 70, 72 at the predetermined output speed and output mail flats with a constant pitch, compensation is needed for the shorter effective curved path channel 64 of drop pocket 42.

This compensation takes the form of delaying mail flats that travel through the shorter path. One method for providing such delay includes providing an uneven or alternating pitch to the mail flats in the input stream and according adjusting the timing of diverter gate 30.

Another method for delaying the shorter path of the current system includes delaying the acceleration of mail flats from drop pocket 42. This method simplifies the control interface with the input feeder and makes the current system more compatible with different input feeders. In this manner, delaying the acceleration of mail flats in drop pocket 42 enables delivery of the mail flats alternately from both drop pockets to the output port 18 with the same pitch and the appropriate velocity.

A further aspect of controlling the acceleration of mail flats is the use of servo motors 94, which have a rotational position that is sensed and coupled back to computer 112. Computer 112 may responsively control the drive current coupled to each servo motor 94 to provide a specific velocity profile (acceleration, maximum speed, and total drive time) and thereby control the acceleration of each mail flat by pinch rollers 60, 62. Again, this control is enhanced by the separation of upper conveyor 70 form its respective drop pocket.

Various modifications and changes may be made by persons skilled in the art to the embodiments described above without departing from the scope of the invention as defined in the appended claims. The present invention is not intended to be limited to the handling of mail flats and may be applied to other similar flat articles. The present invention is also not intended to be limited to the particular conveyor mechanism 14 described above, and may be practiced by any similarly functioning mechanism. It is further possible to practice the present invention using varying degrees of mail flat rotation initiated by the conveyor mechanism 14.

The present embodiment is also illustrated utilizing a dual path, however more paths may also be used.

What is claimed is:

1. A drop pocket system for reorienting flat articles in a serial input stream, comprising:

a drop pocket located to receive a horizontally moving, serial input stream of substantially vertically oriented, flat articles;

a drive mechanism adapted to controllably accelerate flat articles located within said drop pocket in a substantially downward direction; and an effective curved path channel located to receive flat articles moved in a substantially downward direction from said drive mechanism and shaped to convey such received flat articles toward a substantially horizontal orientation, wherein said drop pocket includes an inclined element located to impart rotational movement to each flat article entering said drop pocket using the horizontal movement thereof, and further wherein said drop pocket includes an inclined member located to receive each flat article and stop rotational movement thereof.

2. The system of claim 1, wherein said drop pocket includes a fixed member located for blocking horizontal movement of each flat article and further includes a driven element located for biasing each flat article towards said fixed member.

3. The system of claim 2, wherein said driven element is a driven belt, and further wherein each said flat article is held against said driven belt by a portion of its own weight.

4. The system of claim 1, wherein each said drop pocket includes a trap door located for supporting a bottom edge of each flat article received in the drop pocket, and also includes an actuator adapted for opening said trap door to allow downward movement of flat articles from said drop pocket.

5. The system of claim 4, wherein said drive mechanism includes an engagement mechanism adapted to cause engagement of the flat articles by said drive mechanism.

6. The system of claim 5, wherein said drive mechanism includes a pinch roller oriented to move each article downwardly, and further wherein said drive mechanism includes a servo motor.

7. The system of claim 6, further comprising a control system coupled to said trap door actuator, said engagement mechanism and said servo motor, and adapted to respond to flat articles in said drop pocket to activate said engagement mechanism to engage flat articles with said pinch roller, to activate said trap door actuator to open said trap door and to activate said servo motor to accelerate engaged flat articles.

8. A drop pocket system for reorienting flat articles in a serial input stream, comprising:

a drop pocket located to receive a horizontally moving, serial input stream of substantially vertically oriented, flat articles;

a drive mechanism adapted to controllably accelerate flat articles located in said drop pocket substantially downwardly; and an effective curved path channel including a driven conveyor located to receive flat articles moved substantially downwardly from said drive mechanism and shaped to convey such received flat articles toward a substantially horizontal orientation, said driven conveyor including:

a lower, flexible belt conveyor located to support flat articles along an entire length of said effective curved path channel; and an upper, flexible belt conveyor including a supported driven axle, at least one free axle, and at least one flexible belt engaged by said driven axle and said at least one free axle, wherein said at least one free axle is supported from and kept parallel to said driven axle and has a location which is angularly movable relative to said driven axle, and further wherein said at least one free axle is adapted to place force on said lower, flexible belt conveyor and any flat articles located between said lower, flexible belt conveyor and said at least one free axle.

9. The system of claim 8, wherein said at least one free axle includes a ganged pair of free axles.

* * * * *